United States Patent [19]

Engwall

[11] 4,135,839

[45] Jan. 23, 1979

[54] DEVICE TO PREVENT VEHICLES FROM PASSING A TEMPORARILY SPEED-REDUCED PART OF A ROAD WITH HIGH SPEED

[76] Inventor: Bertil Engwall, Ankdammsgatan 11, Solna, Sweden, S-171 43

[21] Appl. No.: 825,382

[22] Filed: Aug. 17, 1977

[30] Foreign Application Priority Data

Aug. 18, 1976 [SE] Sweden ..... 7609210

[51] Int. Cl.[2] ..... E01F 9/04

[52] U.S. Cl. ..... 404/16

[58] Field of Search ..... 404/15, 14, 13, 12, 404/16, 9, 6

[56] References Cited

U.S. PATENT DOCUMENTS

| | | | |
|---|---|---|---|
| 1,265,404 | 5/1918 | Tuteur | 404/15 |
| 1,357,860 | 11/1920 | Goodrum | 404/15 X |
| 1,671,303 | 5/1928 | McClure | 404/15 X |
| 2,185,020 | 12/1939 | Vostrez | 404/14 |
| 2,457,512 | 12/1948 | Wheeler | 404/15 |
| 2,574,090 | 11/1951 | Dofsen | 404/15 |
| 2,579,467 | 12/1951 | Brickman | 404/12 |
| 4,040,760 | 8/1977 | Wyckoff | 404/14 |

FOREIGN PATENT DOCUMENTS

| | | | |
|---|---|---|---|
| 1041806 | 1953 | France | 404/15 |

OTHER PUBLICATIONS

"Popular Science", 12/47, p. 89.

*Primary Examiner*—Nile C. Byers, Jr.
*Attorney, Agent, or Firm*—Holman & Stern

[57] ABSTRACT

A device to induce vehicles passing a temporarily speed-reduced road section from passing said road section with high speed, including elongated flexible elements, preferably of rubber, placed on the road surface, said elements having beam members extending from the upper surface in a mainly crosswise direction in relation to the direction of the road and in a parallel relationship to each other, the distance between two adjacent beam members being arranged to create a high frequency of vibrations in a vehicle passing with high speed, said distance being larger for a first element passed by a vehicle, thus creating a lower frequency of vibration acting as a warning to the driver.

4 Claims, 4 Drawing Figures

Fig. 1
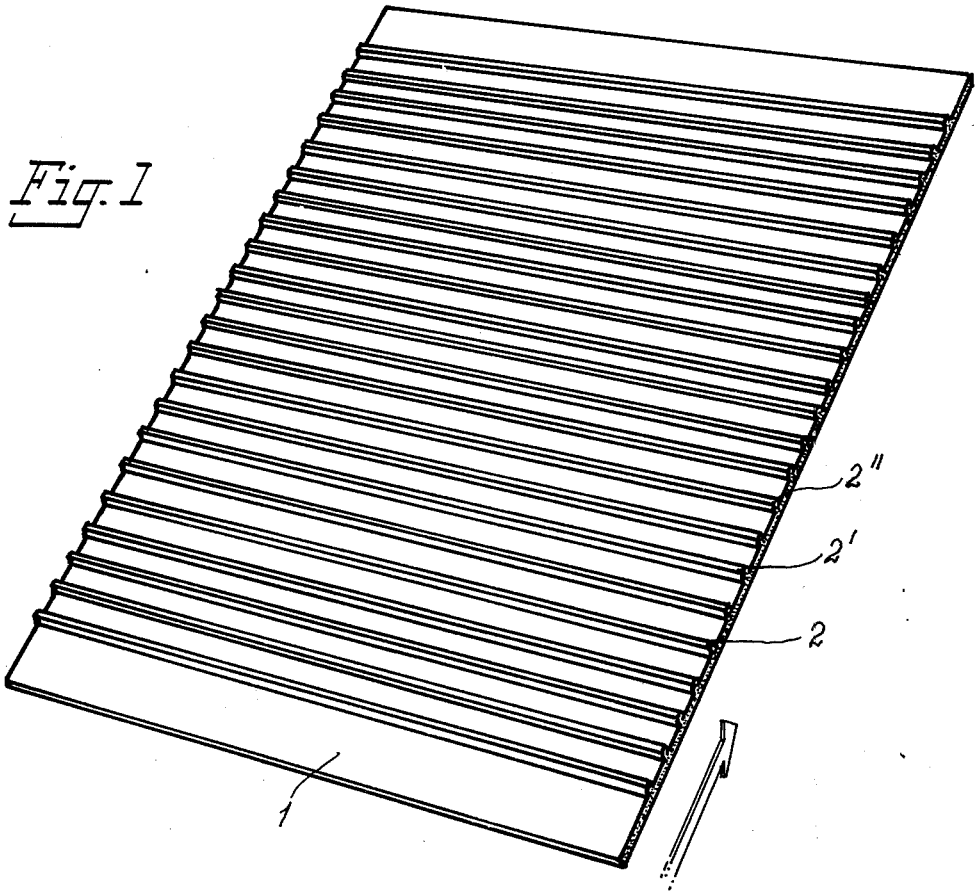
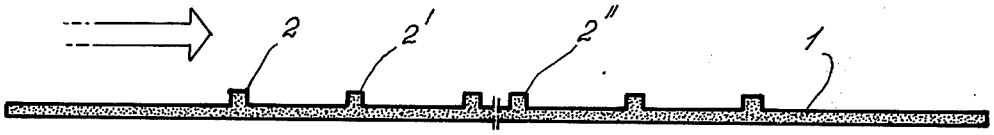
Fig. 2

DEVICE TO PREVENT VEHICLES FROM PASSING A TEMPORARILY SPEEDREDUCED PART OF A ROAD WITH HIGH SPEED

BACKGROUND OF THE INVENTION

The present invention relates to apparatus for inhibiting vehicles from passing a part of a road being subject to a temporarily reduced speed limit at high speed.

It is a well known problem to achieve a reduction in speed for vehicles passing road works or similar temporary obstructions. When working on or adjacent to a road in use, a reduced speed limit is normally used as a means to reduce the risk of accidents of persons on or adjacent to the road. Said reduction in speed is achieved partly by use of road signs, which indicate road works ahead, partly by use of road signs indicating a reduced speed limit. The effect achieved by the use of said warning and maximum speed stipulating signs is never the desired, particularly for road sections which invite a high average speed. A large number of accidents occur each year, causing major damage and injury to persons. In connection with the previously discussed road signs, there have also been attempts made to have a continous police control, with or without speedregistering devices, and this has resulted in an improved result. However, such a control is extremely expensive and means that the personell resources of the police force are tied to certain restricted parts of roads, which is not desirable.

SUMMARY OF THE INVENTION

The object of the present invention is to provide means which reduce the possibility of passing a restricted road section with high speed, e.g. in connection with road works, said means being suitable for a desired period of time, whereafter the previous possibility to speed on the road section is restored. The present invention also concerns a device, which easily can be moved between different work sites and used on desired road sections. The means according to the present invention makes it practically impossible to maintain a high speed for vehicles passing a road section arranged with the device, and the driver is also given a warning before passing the speed reduced section, said warning being of such a type that it can not readily ignored. A particular advantage with the device for utilizing the method according to the present invention is, that it can be manufactured from worn-out tyres from vehicles or similar, thus eliminating a well-known waste problem, as well as reducing the cost of manufacture.

BRIEF SUMMARY OF THE DRAWINGS

FIG. 1 is a perspective view of a device according to the present invention, intended to be arranged by the temporarily speed reduced road section.

FIG. 2 is a side view of the embodiment shown in FIG. 1.

Figure 3:
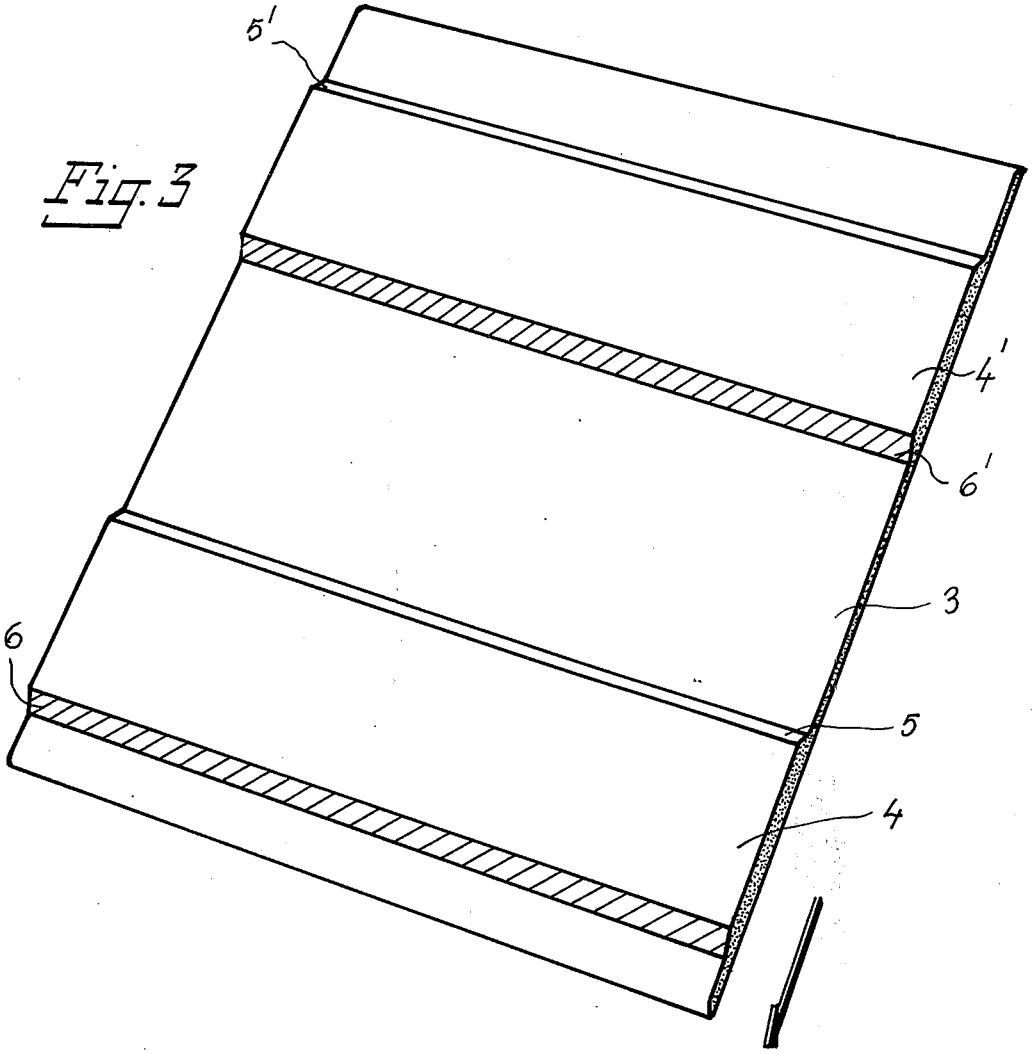
FIG. 3 is a perspective view of a device to be used in connection with the embodiment shown in FIG. 1 and 2, intended to be placed on a road section to be passed before the previously shown device, acting as a warning and a first speed reducing means.

The invention is based on application of speed reducing members or means, as disclosed in FIGS. 1–4, said means or members being applied at a temporarily speed reduced section, as well as before said section with regard to the oncoming direction of approaching vehicles. The device shown in FIGS. 2 and 3 is used to create a bumping phenomena with low frequency, which by means of the wheels, suspension system and the like is transmitted to the body of the vehicle, thus causing vibrations and vibrating sounds. When passing the device disclosed in FIGS. 1 and 2, the frequency of vibrations is greatly increased, thus making it necessary to reduce the speed of the vehicle.

With reference to the embodiment shown in FIGS. 1 and 2, it comprises a longitudinally extending element 1 having a plane lower contact surface to be placed against the surface of the road (road surface not shown), and a number of equally spaced and parallel beam elements 2, 2', 2'' extending from the opposite surface of the element 1, generally at a right angle to the direction of travel for a vehicle passing. Said element 1 has preferably a square or rectangular outer shape and as an example of suitable dimensions, a length of 5 meters in the direction of travel for a passing vehicle, and a width of 4 meters are given. The distance from an edge portion to the edge portion of a beam element can be 0.4 meters, the height and the width of each beam element being 24 and 30 mm respectively and the distance between two adjacent beam elements being 0.2 meters.

The above stated measurements only serve as an example of an embodiment within the scope of the invention, intended to create a suitable vibrating frequency, but the dimensions given can obviously be altered to accomplish other vibrating frequencies, or, for creating an element 1 intended for specific purposes. The length and the width of the element 1 can obviously also be varied as desired.

Figure 4:
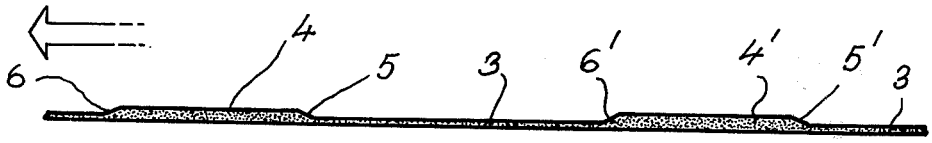
FIG. 4 is a side view of the device shown in FIG. 3.

The element intended for warning purposes as disclosed in FIGS. 3 and 4 comprises also of a longitudinally extending element 3, having a preferably plane contact surface directed towards the surface of the road and beam members, 4, 4', extending perpendicularly to the direction of travel for a passing vehicle. Said beam members 4, 4' each have an upper surface directed from the element 3, which extends considerably further in the direction of travel compared with the corresponding surface on the beam members 2, 2', 2'' discussed with reference to the first element 1. Furthermore, the surfaces joining said upper surfaces with the upper surface of the element 3 are inclined, whereby the beam members in cross-section resemble the configuration of a trapezium. The inclined planes 5, 5', which face in one direction, are advantageously arranged with a coloured, e.g. white, surface structure with reflecting properties, and the oppositely inclined planes 6, 6' are advantageously arranged with a red reflecting surface, whereby the element 3 easily can be seen when travelling in the dark. The distance between two adjacent beam elements 4, 4' is relatively large, thus causing a bumping or vibrating frequency which is considerably lower than the frequency created by previously discussed element 1. The element 3 shown in FIGS. 3 and 4 can thus be passed with a higher speed than the element 1 shown in FIGS. 1 and 2, but the element 3 causes such noise and vibrations, that the driver finds it necessary to reduce the speed of the vehicle, thereby also acting as an effective warning means for following elements.

As an example of how a warning element 3 can be dimensioned, a width in the direction of the beam elements 4, 4' of 4 meters is suitable, corresponding to the previously discussed element 1, and a length in the region of 3 meters. As a distace from an edge portion to a first and adjacent beam member 4, 4' 0.4 meters is suitable, the length of each beam element 4, 4' in the direction of travel being 0.7 meters and the distance between two adjacent beam members 4, 4' being 1 meter. The inclined planes 5, 5', 6, 6' of the beam elements 4, 4' can be inclined to the vertical plane with an inclination angle of 60°. The described and shown embodiment can be arranged with a height relationship between the upper surface of the element 3 directed from the road and the upper surfaces of the beam members 4, 4' in the region of 50 mm.

The dimensions given above only intend to serve as guidance when designing an embodiment within the scope of the invention. This means, that all dimensions and shapes can be varied as desired to accomplish desired noise and vibrations and the outside dimensions can obviously also be varied as desired.

The above described elements 1, 3 are placed on a road surface in such a way, that the elements shown in FIGS. 3–4 first is passed by vehicle. At a normal distance of warning before the element 3, a speed limit road sign is placed indicating a reduced speed, preferably together with a road sign indicating bumpy road ahead. The elements 1, 3 are placed at a distance in the region of 100 meters from each other, the warning element 3 obviously being placed in such a way, that said element is the first element to be passed.

The speed reducing elements 1, 3 are together with the beam members 2, 2', 2'', 4, 4' preferably manufactured from rubber or similar material, and as a basic material worn-out tyres from vehicles can be used. Thus the device can be made from waste material, which assists in solving a common waster problem and also facilitates a low cost of manufacture. The elements can also be wheft reiforced, in order to achieve better resistance against outside forces.

The weight of the elements 1, 3, in connection with the frictional properties, makes it possible to use the elements on a dry tarmac road surface without any means for holding the elements to the road surface, whereby damage to the road is avoided. Furthermore, application of the elements 1, 3 to the road is thus a simple and fast operation. In view of the modern machinery used to-day at roadworks, transport and application of the elements is no problem. These can advantageously be transported by means of lorrys, road working machinery or any other type of transport vehicle.

The device according to the present invention can thus easily be applied/removed to/from a work site, and transported to another work site. The fact that the device can be used a repeated number of times at different work sites makes it an extremely efficient and economical protective means for work sites on or adjacent to a road. The vibrating, shaking and noise phenomena created when passing the device should cause the driver of a vehicle to immediately take actions to reduce the speed of the vehicle, whereby the objective of the invention is achieved.

It should be emphasized, that the shown and described device can be modified in a number of ways, both with regard to the outside shape as well as the shape of the beam elements and also with regard to the attachment against the road surface. In view of the fact that normally the weight and frictional properties of the device makes it possible to use the device without anchoring means, no such means have been shown or discussed. However, it is easily understood, that the device can be attached to the road surface by means of bolts or nails, in which case co-operating means of attachment also are arranged in the elements 1, 3. The shown and described device is therefore only an example of a preferred embodiment within the scope of the invention, and many other embodiments are possible, maintaining the important and characteristic feature, namely to use mat-shaped elements having means directed from the road surface, said means being arranged to create a vibrating and noise phenomena in a vehicle passing over the elements and extending from said elements. The invention also includes the use of two types of mat-shaped elements, a first element being arranged to create a first and lower frequency of vibrations, and a second mat-shaped means, arranged with means for creation of a second and higher frequency of vibrations.

I claim:

1. Apparatus for laying on a road surface to induce a vehicle driver to reduce speed comprising a first elongated mat element for creating a relatively low bumping frequency in a vehicle when passing over said first element and a second elongated mat element for creating a relatively high bumping frequency in the vehicle when passing over said second element, said first element including a road contact surface and a series of substantially trapezium section substantially parallel transverse beam elements on an upper surface of said first element opposite said road contact surface, each trapezium section beam element having a top surface substantially parallel to said road contact surface of said first element and having side surfaces inclined outwardly from said top surface, said second element also including a road contact surface and a series of substantially rectangular section substantially parallel transverse beam elements on an upper surface of said second element opposite said road contact surface, said beam elements of said second mat element being of smaller width and being more closely spaced apart than said beam elements of said first mat element.

2. The apparatus of claim 1 wherein said side surfaces of said beam elements of said first mat element which side surfaces face in one direction have reflective properties.

3. The apparatus of claim 2, wherein the other side surfaces of said beam elements of said first mat element also have reflective properties and are differently colored to the side surfaces facing in said one direction.

4. The apparatus of claim 1 wherein each mat element is a one-piece construction of flexible material.

* * * * *